US006468109B1

(12) United States Patent
Wu

(10) Patent No.: US 6,468,109 B1
(45) Date of Patent: Oct. 22, 2002

(54) BOARD LOCK DEVICE FOR ELECTRICAL CONNECTOR

(75) Inventor: Jerry Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/112,922

(22) Filed: Mar. 29, 2002

(51) Int. Cl.[7] ..... H01R 13/73
(52) U.S. Cl. ..... 439/567; 439/610
(58) Field of Search ..... 439/567, 571, 439/572, 607–610

(56) References Cited

U.S. PATENT DOCUMENTS 5,599,207 A * 2/1997 Lai ..... 439/357
5,820,393 A * 10/1998 Edgley et al. ..... 439/181
6,077,115 A * 6/2000 Yang et al. ..... 439/567
6,287,146 B1 * 9/2001 Avery et al. ..... 439/607

* cited by examiner

*Primary Examiner*—Gary F. Paumen
*Assistant Examiner*—James R. Harvey
(74) *Attorney, Agent, or Firm*—Wei Te Chung

(57) ABSTRACT

A board lock device (30) is useable for one type of electrical connectors having different heights and has a first member (3) and a second member (4) separate from and engagable with the first member. The first member has a retaining portion (32), a resilient beam (34) extending from one end of the retaining portion for mating with a grounding member of a complementary connector, and a contact portion (36) extending from another end of the retaining portion. The second member has a body portion (42) for conductively contacting with the contact portion of the first member and a pair of legs (44) depending from the body portion for attaching the electrical connector to a circuit board.

1 Claim, 15 Drawing Sheets

BOARD LOCK DEVICE FOR ELECTRICAL CONNECTOR

CROSS-REFERENCE TO RELATED APPLICATION

This application is a co-pending application of U.S. patent application Ser. No. 09/912,850, entitled "ELECTRICAL CONNECTOR WITH IMPROVED BOARD LOCKS", filed on Jul. 24, 2001 by Jerry Wu and assigned to the same assignee of the present application. The disclosure of the co-pending application are wholly incorporated herewith by reference.

BACKGROUND OF THE INVENTION

1. Field of the Invention

The present invention relates to a board lock device for use in an electrical connector, and particularly to such a board lock device whose height is adjustable so that it can be used in electrical connectors having different heights.

2. Description of Related Art

Electrical connectors employing grounded board lock devices are widely used in computer industry, as is disclosed in U.S. Pat. No. 6,287,146 and U.S. patent application Ser. No. 09/912,850. Referring to FIG. 16 of the present application, a board lock device 8 disclosed in the co-pending U.S. patent application Ser. No. 09/912,850 is shown, which is single piece, and used for attaching an electrical connector to an underlying circuit board. The board lock device 8 is stamped and formed from a metal plate, and is integrally formed with a retaining portion 82 retained in an insulative housing of the electrical connector, a grounding beam 84 extending horizontally from one end of the retaining portion 82 for mating with a complementary connector to establish a grounding route, and a board lock vertically extending from the other end of the retaining portion 82 to latch in the underlying circuit board. The board lock device 8 can only be used in the electrical connector having a predetermined height. Thus, different heights of the board lock devices must be manufactured to meet the demand of the electrical connectors having different heights. To provide different board lock devices having different heights is costly in manufacturing and inventory management.

Hence, an improved board lock device used for an electrical connector is required to overcome the disadvantages of the prior art.

BRIEF SUMMARY OF THE INVENTION

A main object of the present invention is to provide a board lock device used for electrical connectors having different types or heights.

A board lock device in accordance with the present invention is useable for one type of electrical connectors having different heights. The board lock device has a first member and a second member separate from and engageable with the first member. The first member has a retaining portion, a resilient beam extending from one end of the retaining portion for mating with a grounding member of a complementary connector, and a contact portion extending from another end of the retaining portion. The second member has a body portion for conductively contacting with the contact portion of the first member and a pair of legs depending from the body portion for attaching the electrical connector to a circuit board.

Other objects, advantages and novel features of the invention will become more apparent from the following detailed description of the present embodiment when taken in conjunction with the accompanying drawings.

DETAILED DESCRIPTION OF THE INVENTION

Reference will be made to drawings for more detailed description of the present invention.

Figure 1:
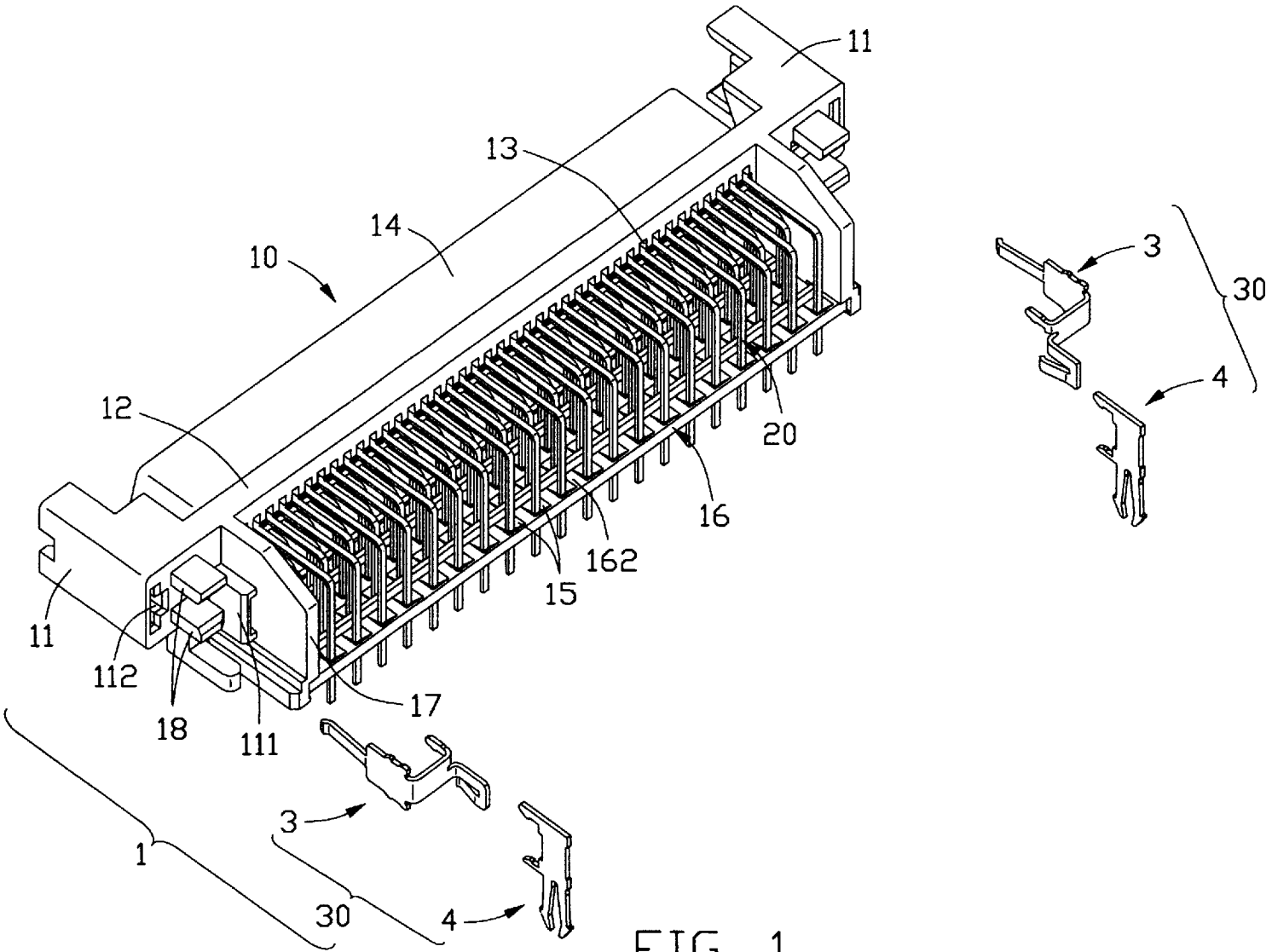
FIG. 1 is an exploded perspective view of an electrical connector in accordance with a first embodiment of the present invention.

Referring to FIG. 1, an electrical connector 1 in accordance with a first embodiment of the present invention includes a dielectric housing 10, a plurality of terminals 20 retained in the dielectric housing 10 and a pair of board lock devices 30 attached to opposite ends of the housing 10.

Figure 4:
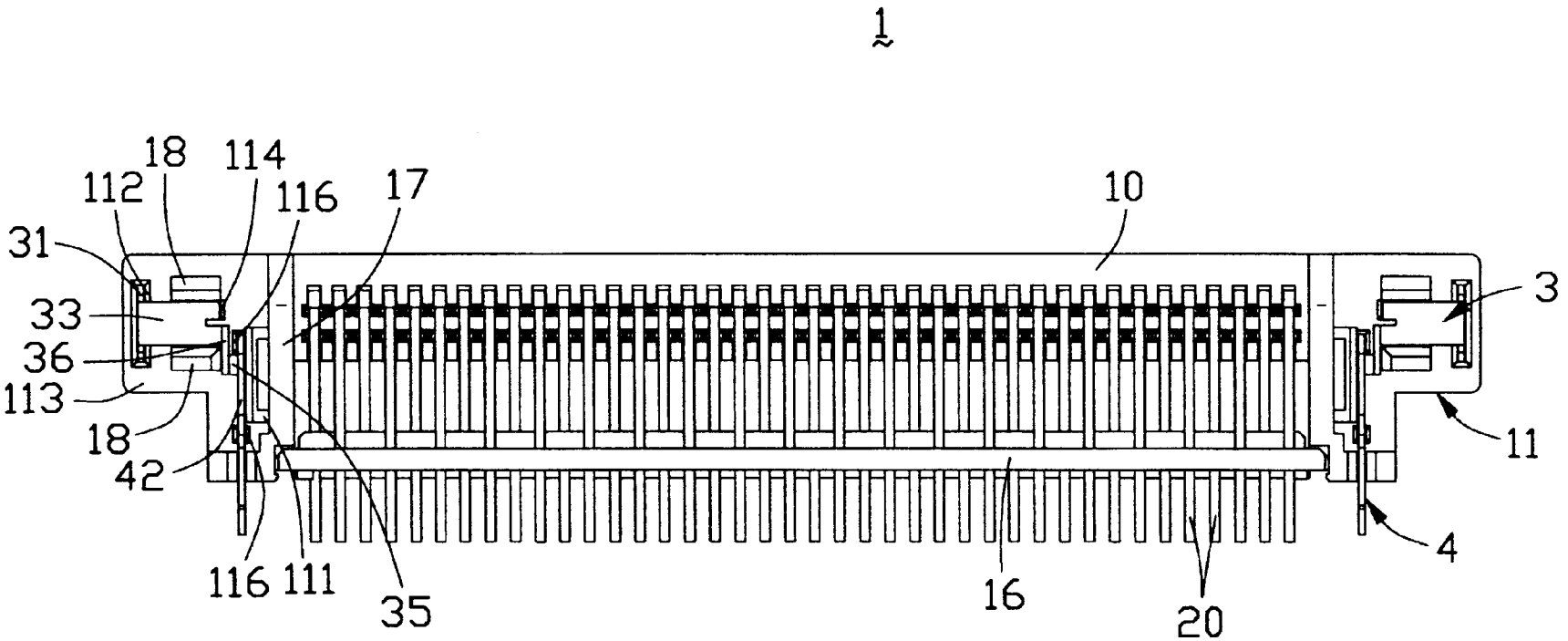
FIG. 4 is a front view of FIG. 3.
Figure 5:
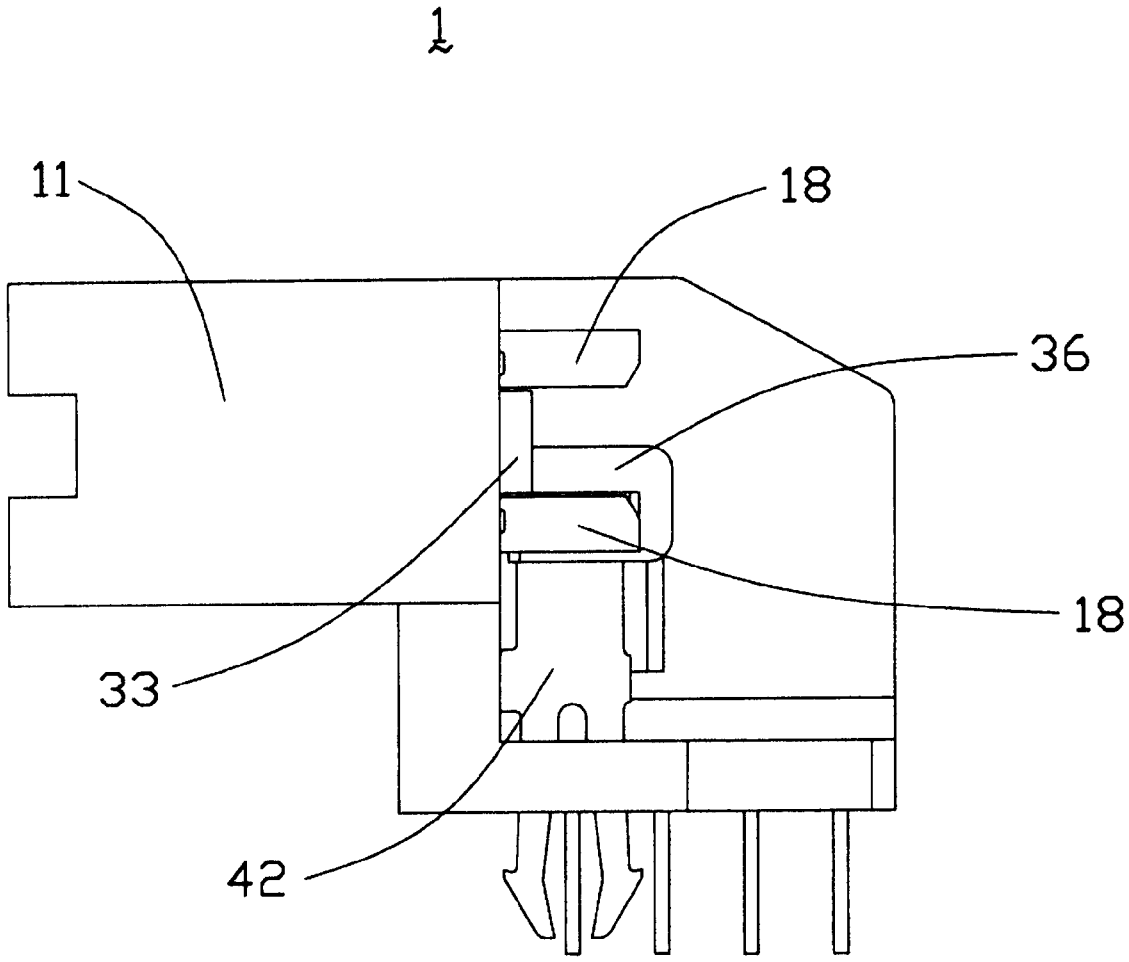
FIG. 5 is a side view of FIG. 3.

Further referring to FIGS. 3 to 6, the dielectric housing 10 has a body plate 12, a shroud 14 and a spacer 16 forwardly and backwardly extending from opposite sides of the body plate 12, respectively. The housing 10 defines two rows of passageways 13 extending through both the body plate 12 and the shroud 14 for receiving the terminals 20. The spacer 16 has a body portion 162 and a pair of partition walls 17 extending upward from opposite ends of the body portion 162 and connecting with the body plate 12. The body portion 162 defines four rows of positioning holes 15 staggeredly arranged for positioning corresponding terminals 20. Additionally, a pair of side wings 11 project forward from the body plate 12 and locate beside the shroud 14. As best seen in FIG. 4, each side wing 11 defines a first through hole 112 in an outer side thereof, a second through hole 114, and a pair of upper and lower third through holes 116 adjacent to the second through hole 114. Additionally, a pair of upper and lower projections 18 extend backward from a rear surface 113 of the side wing 11 and are spaced apart with a predetermined distance. Furthermore, a positioning protrusion 111 is formed at the common boundary of each side wing 11 and an adjacent partition plate 17.

Figure 6:
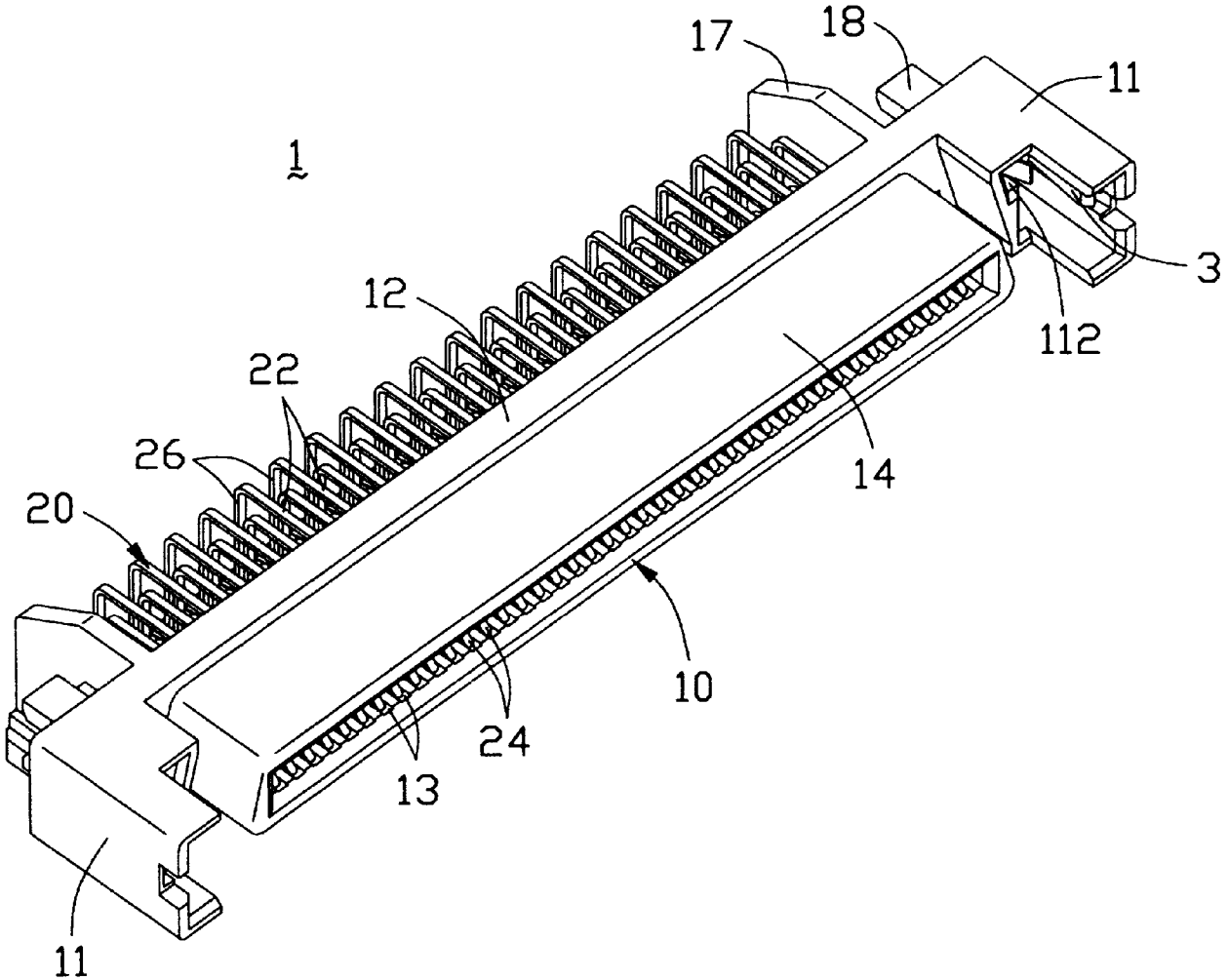
FIG. 6 is another perspective view of FIG. 3.
Figure 7:
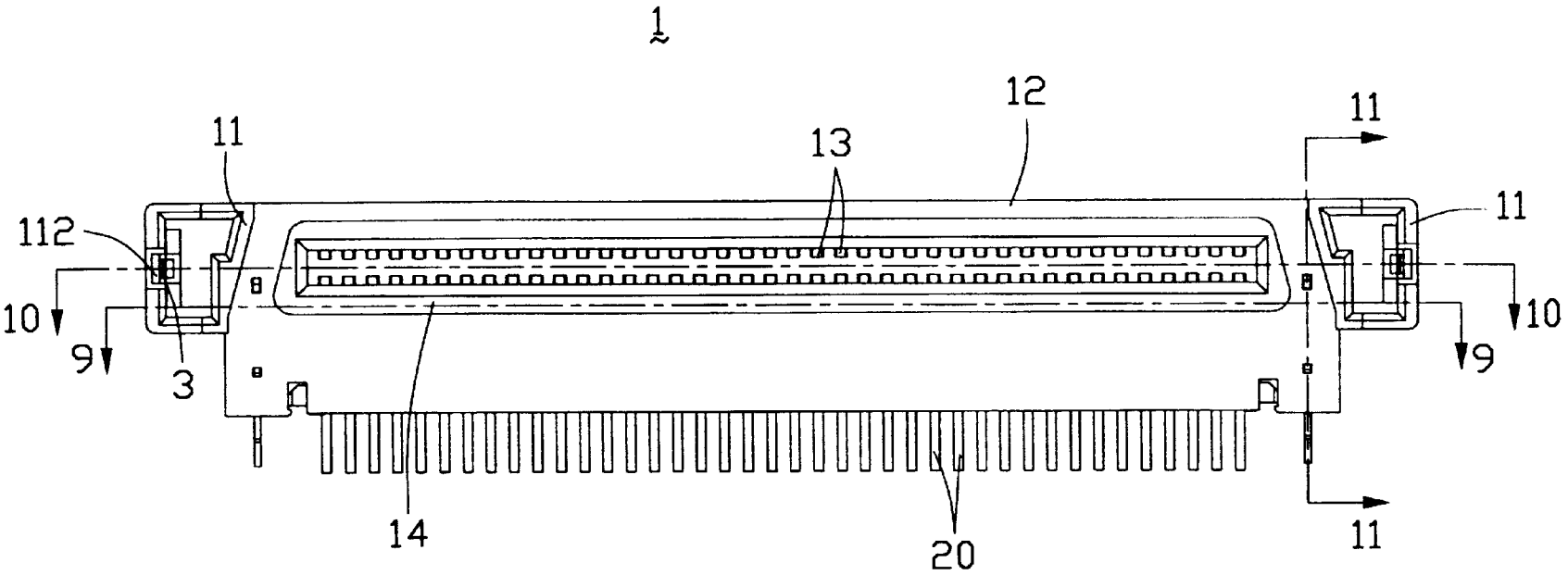
FIG. 7 is a front view of FIG. 6.
Figure 8:
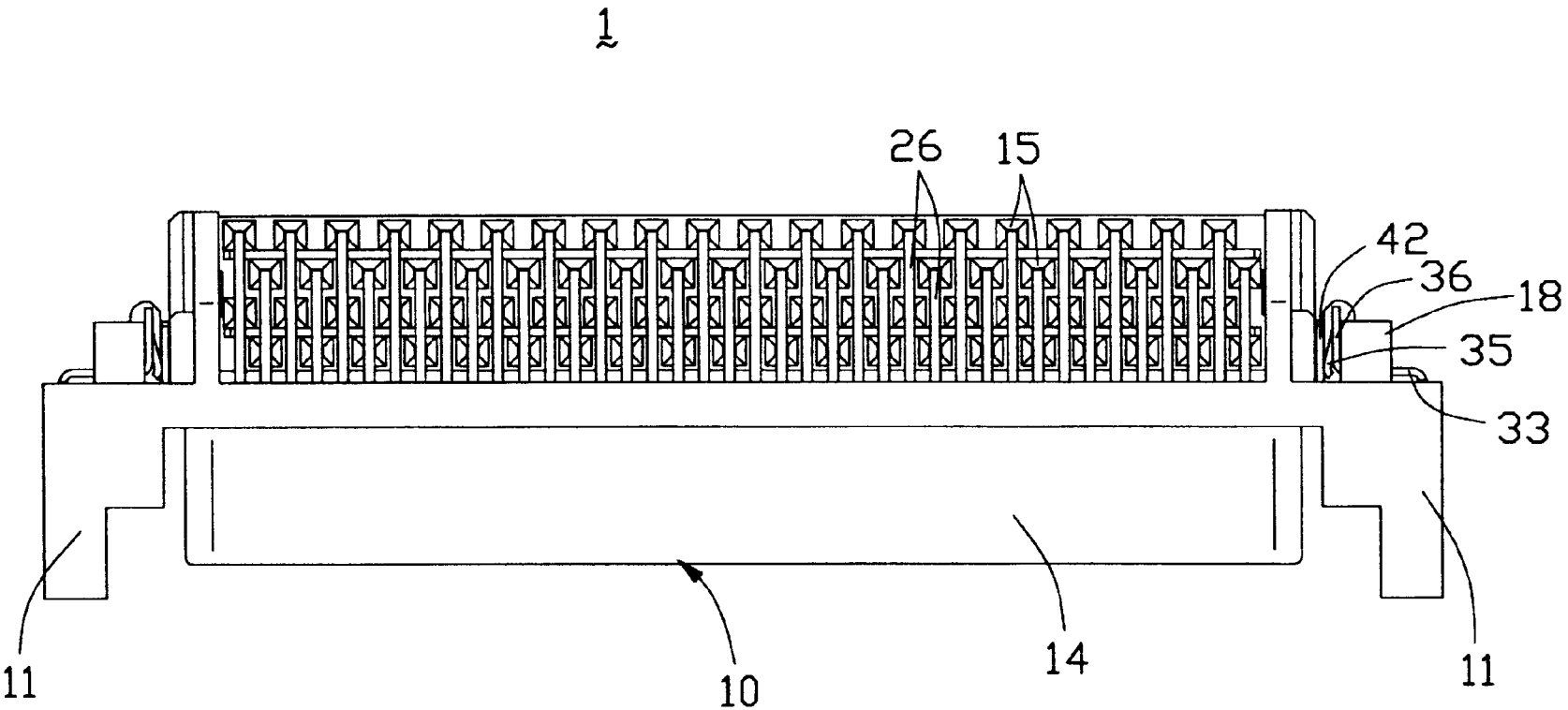
FIG. 8 is a top view of FIG. 6.
Figure 9:
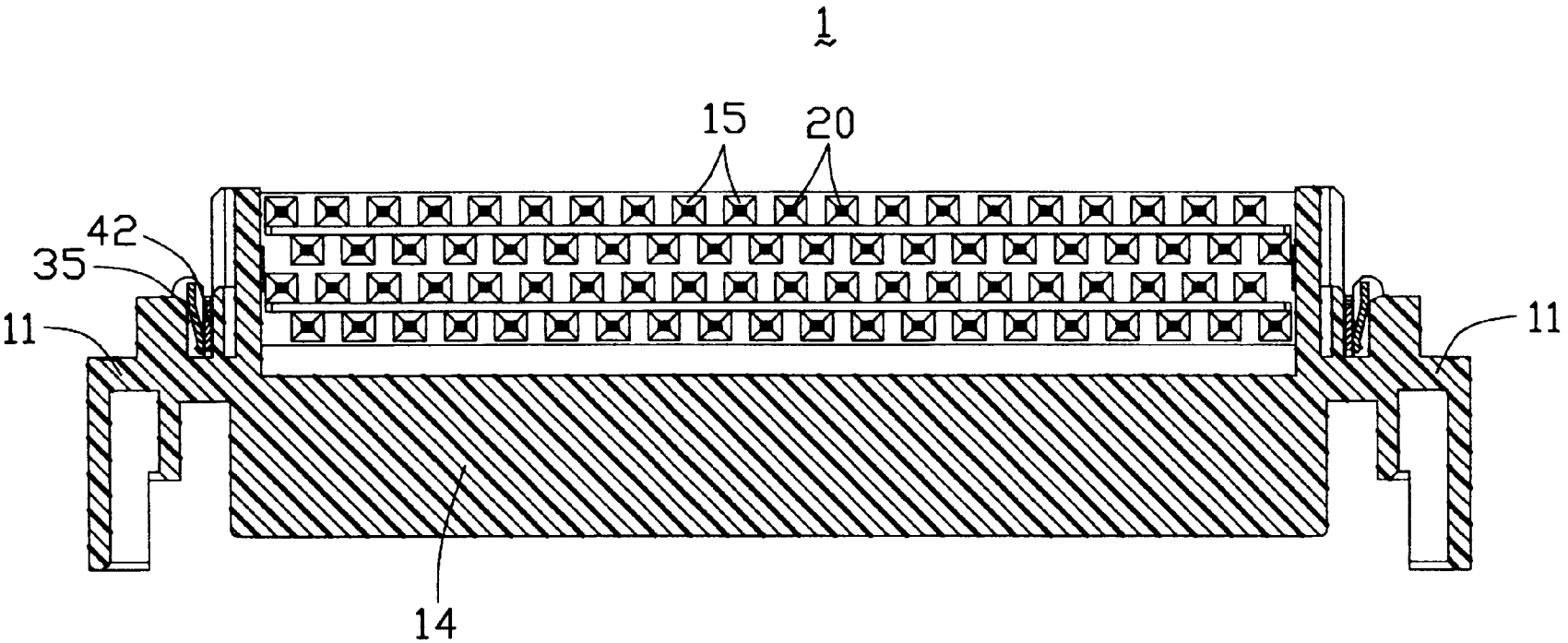
FIG. 9 is a cross-sectional view taken along line 9—9 of FIG. 6.
Figure 10:
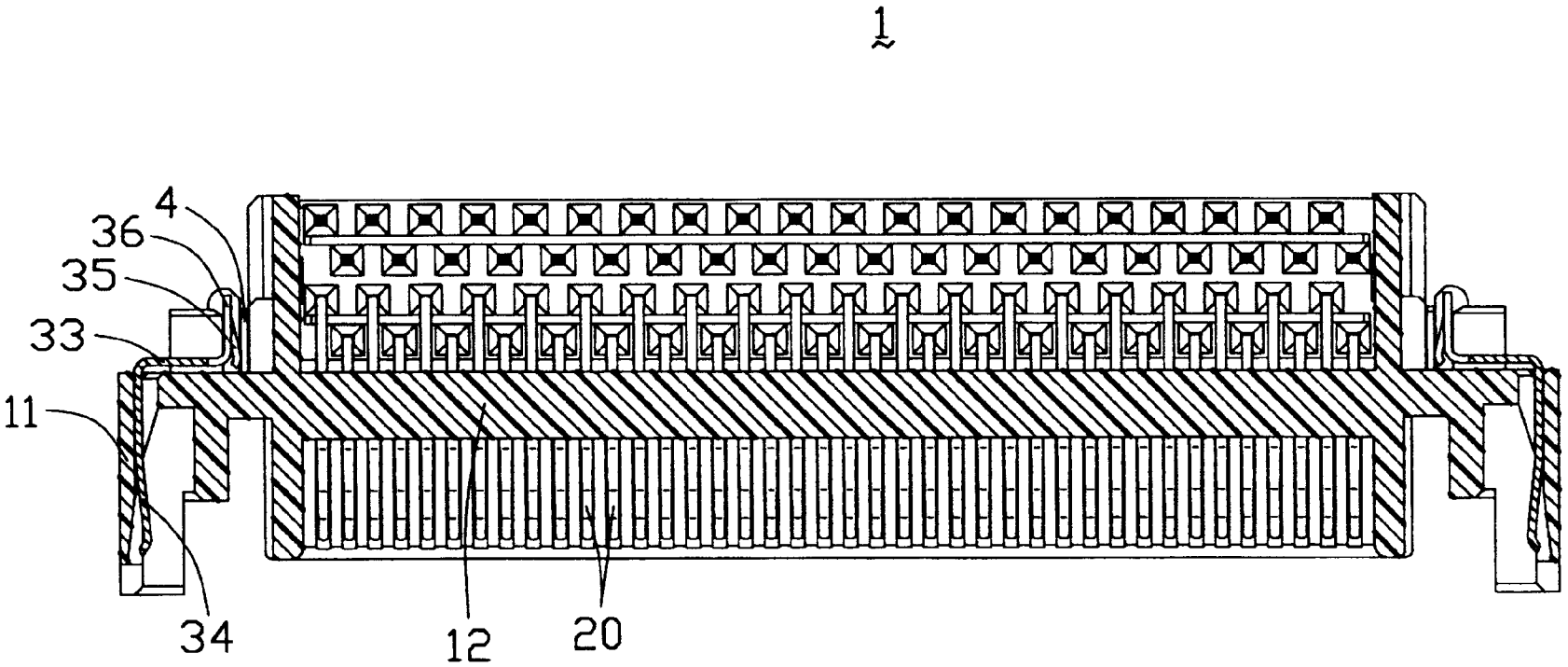
FIG. 10 is a cross-sectional view taken along line 10—10 of FIG. 6.
Figure 11:
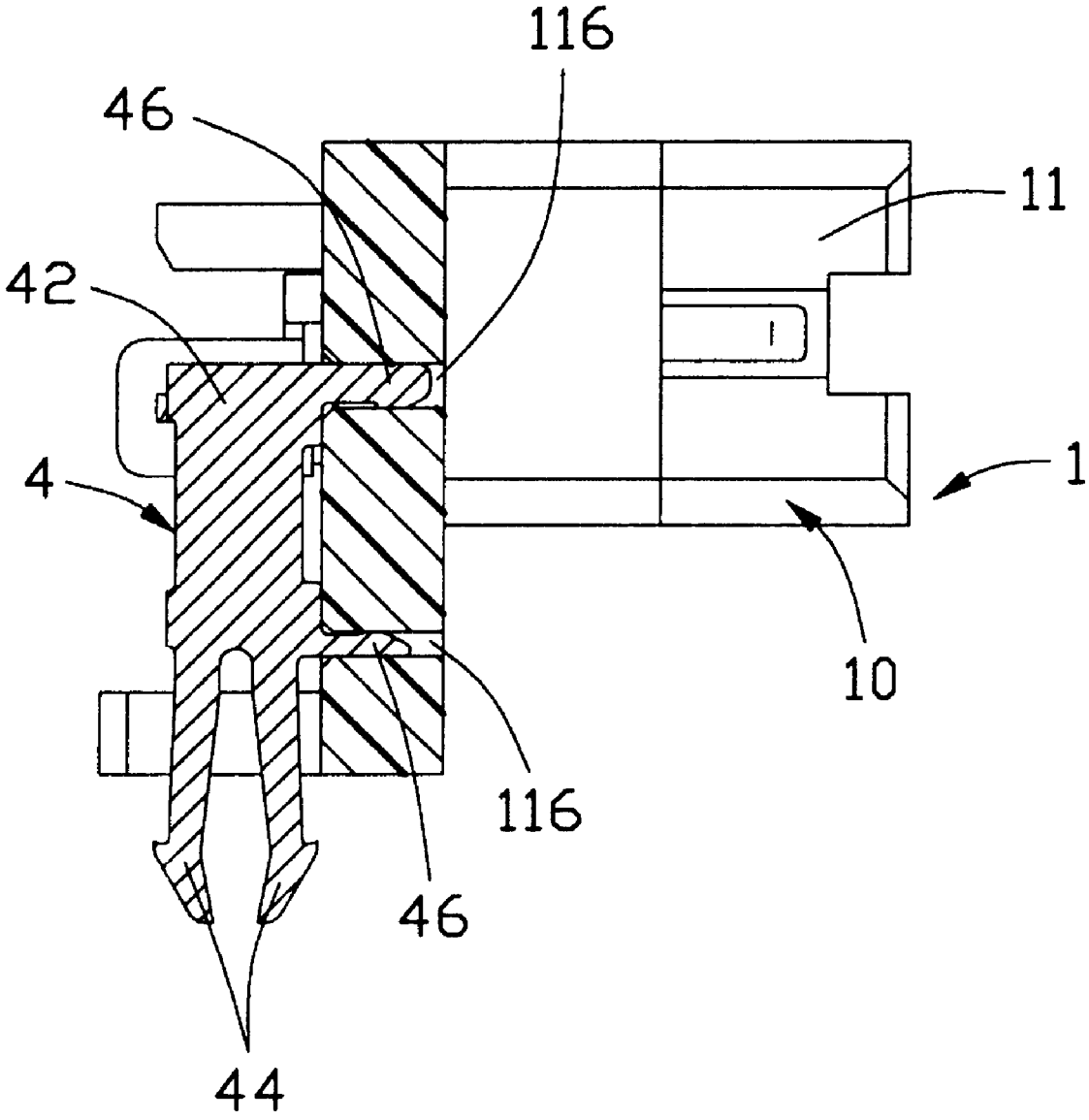
FIG. 11 is a cross-sectional view taken along line 11—11 of FIG. 6.
Figure 12:
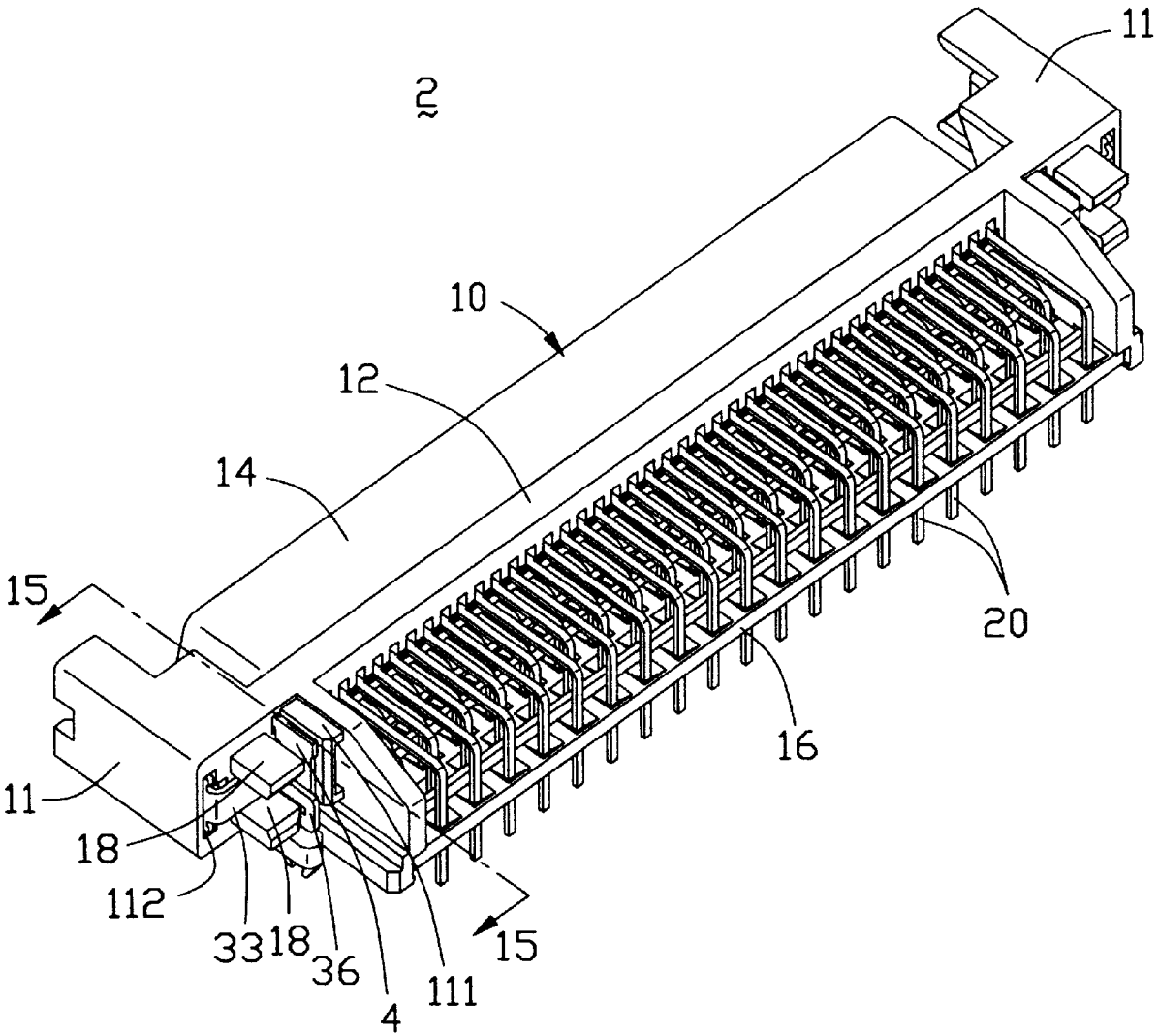
FIG. 12 is an assembled perspective view of an electrical connector in accordance with a second preferred embodiment of the present invention.
Figure 13:
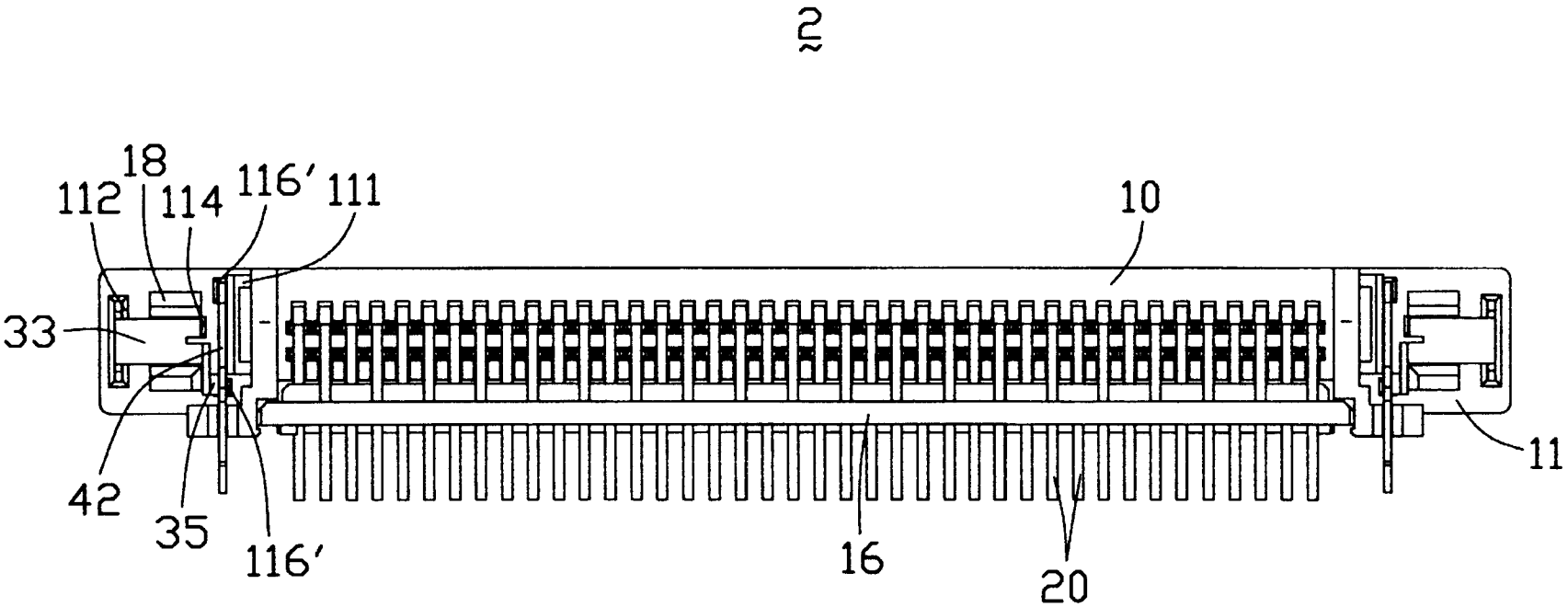
FIG. 13 is a front view of FIG. 12.
Figure 15:
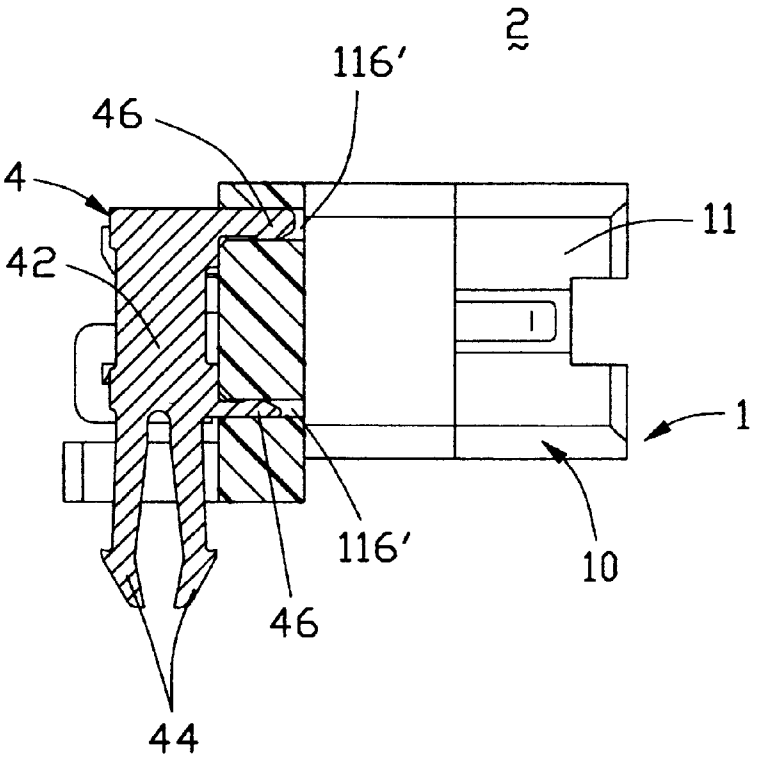
FIG. 15 is a cross-sectional view taken along line 15—15 of FIG. 12.
Figure 14:
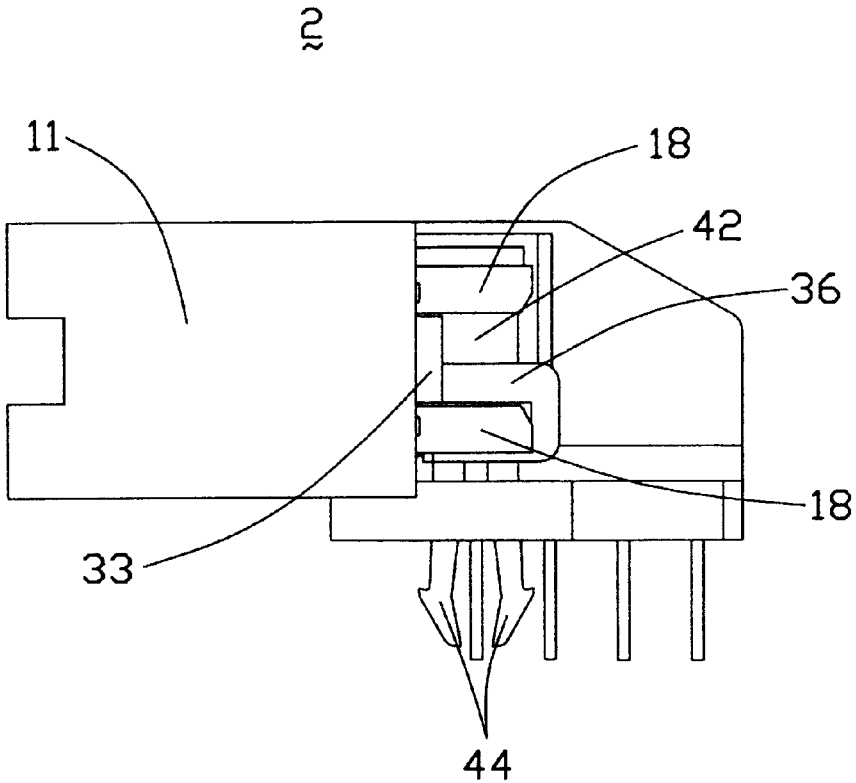
FIG. 14 is a side view of FIG. 12.
Figure 16:
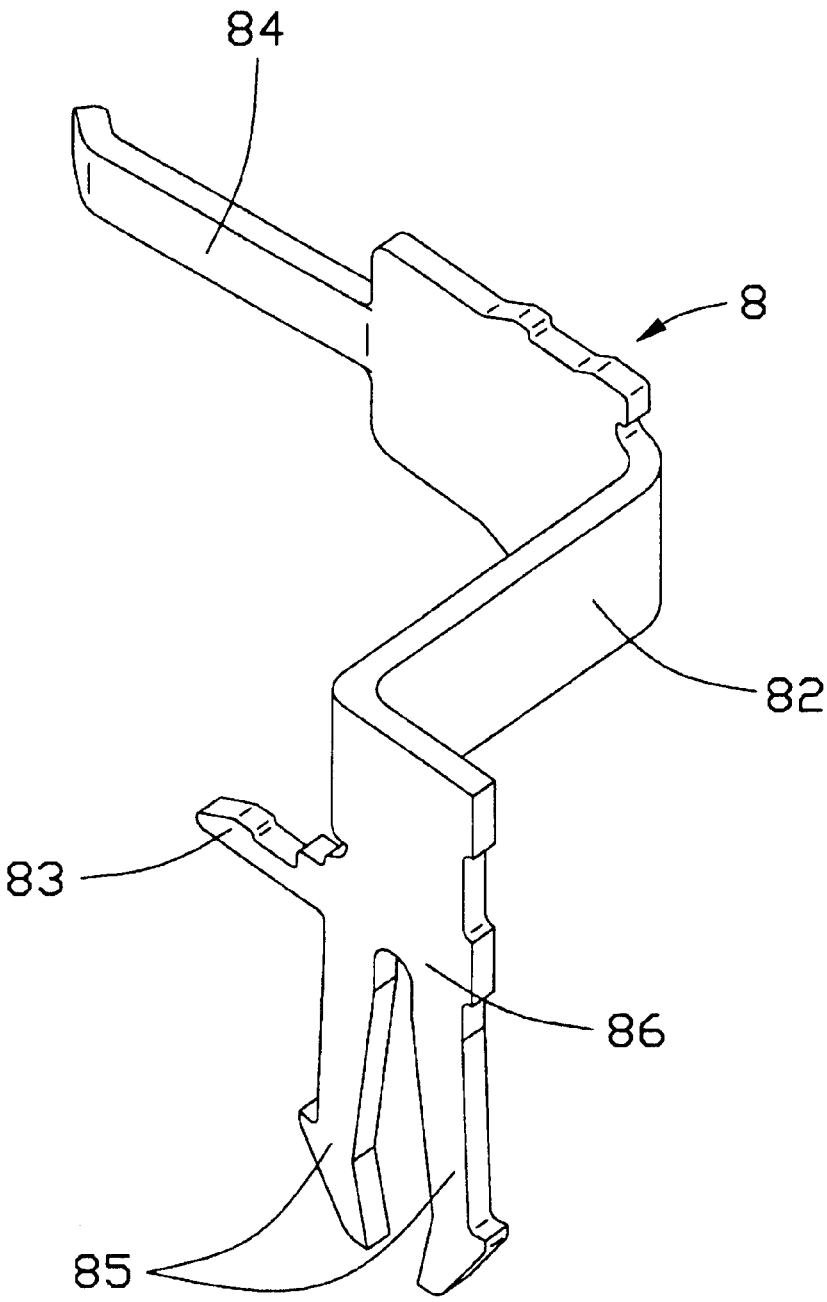
FIG. 16 (RELATED ART)
FIG. 16 is a perspective view of a board lock device for use in an electrical connector in accordance with co-pending application Ser. No. 09/912,850.

Referring to FIGS. 1 and 6, each terminal 20 has a retaining portion 22 partially received in a corresponding passageway 13, a mating portion 24 extending forward from one end of the retaining portion 22 into the shroud 14, and a soldering tail 26 vertically depending from the other end of the retaining portion 22 and passing through a corresponding positioning hole 15 for soldering to an underlying circuit board (not shown). In this way, the soldering tails 26 of the terminals 20 are staggeredly positioned by the positioning holes 15 of the spacer 16 to be soldered to the circuit board.

Figure 2:
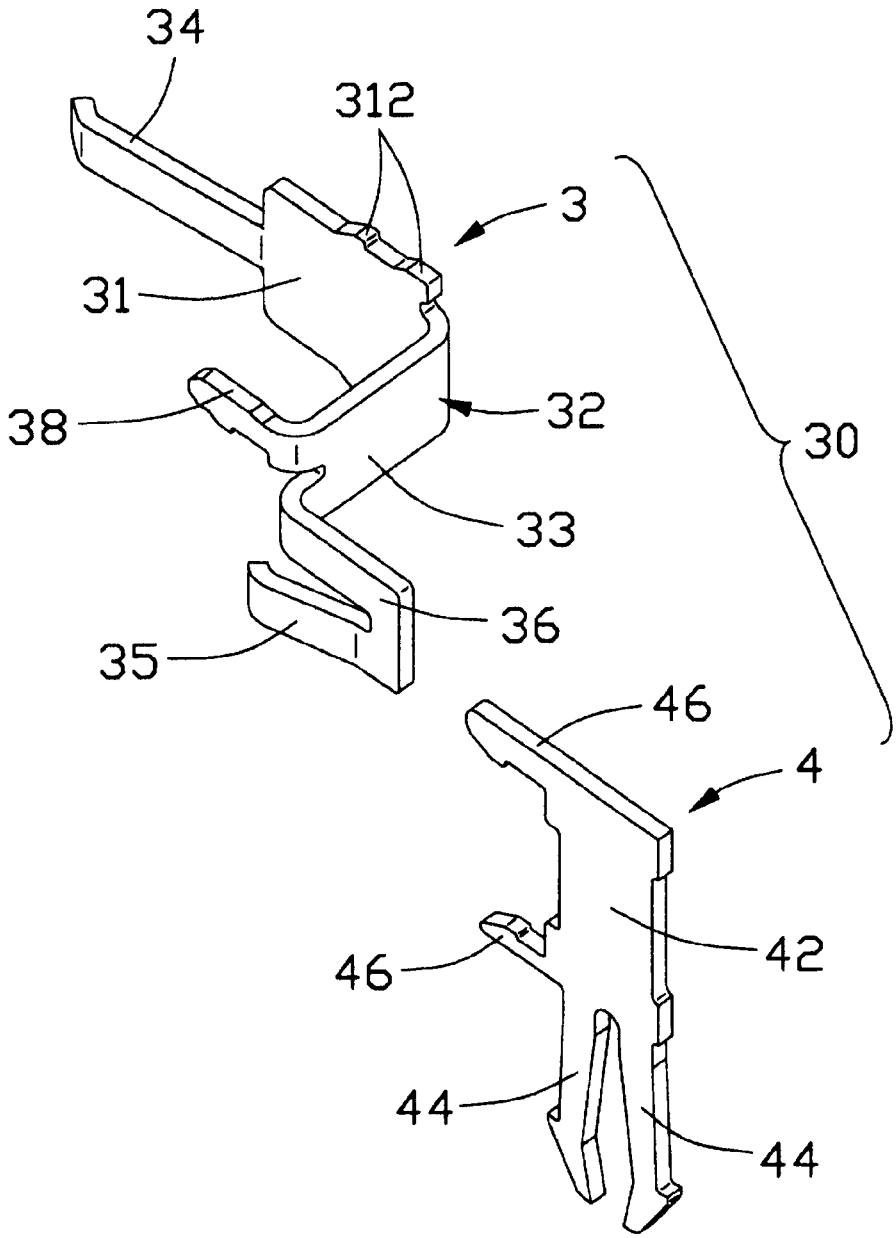
FIG. 2 is an enlarged perspective view of a board lock device of the electrical connector of FIG. 1.
Figure 3:
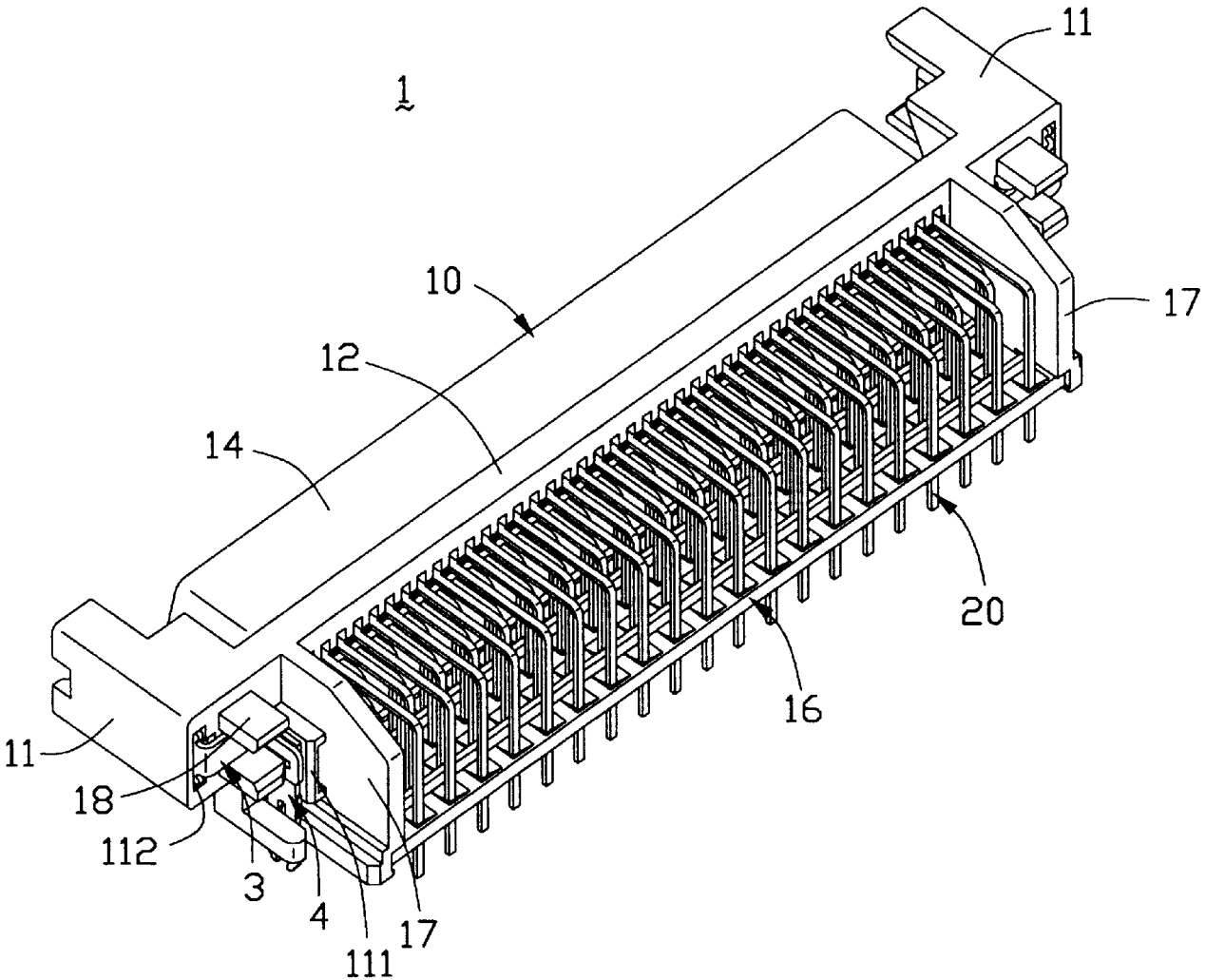
FIG. 3 is an assembled view of FIG. 1.

Referring to FIGS. 1 and 2, the board lock device 30 is stamped and formed from a metal sheet and has two separate pieces to be mated with each other when they are assembled in the dielectric housing 10 of the electrical connector 1. One piece is a grounding piece 3 and the other is a latching piece 4. The grounding piece 3 has a generally L-shaped body portion 32, a resilient beam 34 and a contact portion 36 extending forward and backward from opposite ends of the body portion 32, respectively. The body portion 32 includes a retaining section 31 having a plurality of barbs 312 on top and bottom edges thereof for retaining in the through hole 112, and an abutting section 33 vertically extending from a rear end of the retaining section 31. The resilient beam 34 is inserted into the through hole 112 of the housing 10 for mating with a corresponding grounding member (not shown) of the complementary connector to thereby establish a grounding route when the connector 1 and the complementary connector are mated with each other. The contact portion 36 vertically extends from a lower portion of a free end of the abutting section 33 and forms a curved beam 35 projecting toward in a direction into the connector 1 for conductively contacting with the latching piece 4. Additionally, a latch 38 extends forward from an upper portion of the free end of the abutting section 33 in a direction opposite the contact portion 36.

The latching piece 4 has a structure similar to that of a conventional board lock, and comprises a body section 42, a pair of bifurcated legs 44 depending downward from the body section 42 for insertion into the underlying circuit board. Furthermore, a pair of upper and lower latches 46 project forward from the body section 42 for insertion into the third through holes 116 of the housing 10.

In assembly, referring to FIGS. 3 to 11, the terminals 20 are firstly fitted into corresponding passageways 13 and the soldering tails 26 thereof are positioned in corresponding positioning holes 15 of spacer 16 of the housing 10. The board lock devices 30 are then assembled with corresponding side wings 11 of the housing 10, as is best seen in FIG. 4. The resilient beam 34 and the retaining section 31 of the grounding piece 3 are inserted into the first through hole 112, while the latch 38 of the grounding piece 3 is retained into the second through hole 114. Meanwhile, the abutting section 33 of the grounding piece 3 is interferingly positioned between the two projections 18. Finally, the latching piece 4 is interferingly inserted between the contact portion 36 of the grounding piece 3 and the positioning protrusion 111, and the upper and lower latches 46 thereof are inserted into corresponding third through holes 116. Therefore, the body section 42 of the latching piece 4 is conductively contacted with the curved beam 35 of the grounding piece to form a grounding route after the connector 1 and the complementary connector are mated with each other.

Further referring to FIGS. 12 to 15, an electrical connector 2 in accordance with a second preferred embodiment of the present invention is shown, and it is noted that the same or similar components of the electrical connectors in the first and second preferred embodiments of the present invention are referenced by the same numbers or labels for convenience. The electrical connector 2 has a substantial identical structure to that of the electrical connector 1 in the first embodiment of the present invention except that it has a different height and a different location of the pair of third through holes 116' from those of the electrical connector 1. In this situation, the board lock device 30 is still usable for the electrical connector 2, as will be described below. The grounding piece 3 is still assembled with the same components of the housing 10 as described in the first embodiment of the present invention, such as first and second through holes 112, 114, and the projections 18. The upper and lower lathes 46 of the latching piece 4 are fitted into the modified third through holes 116' to adjust the height of the latching piece 4 with respect to the underlying circuit board, and the body section 42 conductively contacts the curved beam 35 of the grounding piece 3. In this way, the board lock device 30 of the present invention is usable for electrical connectors having a same structure while different heights or types.

In conclusion, since in the present invention, the latch piece 4 and the grounding piece 3 are separable with each other, the contacting point between the curved beam 35 and the body portion 42 is adjustable to change the height of the board lock device 30, thereby adapting the board lock device 30 to electrical connectors having different heights. More specially, if the curved beam 35 engages a lower part of the body portion 42 when the grounding piece 3 and the latching piece 4 are assembled to a housing of a connector, the board lock device 30 can be used in the connector having a relatively low profile. On the other hand, if the curved beam 35 engages an upper part of the body portion 42 when the grounding piece 3 and the latching piece 4 are assembled to a housing of a connector, the board lock device 30 can be used in the connector having a relatively high profile. Furthermore, once one of the grounding piece 3 and the latching piece 4 of the board lock device 30 is damaged, the remaining is still useable. Consequently, the board lock device 30 in accordance with the present invention is more economical in use than the single-piece board lock device described in the related art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of passageways;

a plurality of conductive contacts received in the passageways; and a plurality of board lock devices being assembled to respective ends of the insulative housing and having a first member adapted for electrically engaging with a complementary connector and a second member adapted for latching the electrical connector to a circuit board, the second member conductively contacting with and being separable from the first member;

wherein the insulative housing forms a pair of side wings at opposite sides thereof and each side wing defines a plurality of through holes and forms a pair of projections and a positioning block;

wherein the board lock devices are assembled with the side wings of the insulative housing;

wherein the first member of each board lock has a retaining body, a resilient beam and a contact portion extending from opposite ends of the retaining body;

wherein the retaining body has a first section forming several barbs, and a second section vertical to the first section;

wherein the contact portion of the first member extends from a lower portion of one end of the second section, and a latch extends from an upper portion of the one end of the second section and opposite to the contact portion;

wherein the contact portion of the first member forms a curved contact beam;

wherein the second member has a body portion for conductively contacting the curved contact beam of the first member, a pair of bifurcated legs depending downward from a lower end of the body portion for latching into the circuit board, and a pair of upper and lower arms extending from one side edge of the body portion for fitting into corresponding through holes of the side wing of the insulative housing.

* * * * *